US006660111B2

(12) United States Patent
Taguchi et al.

(10) Patent No.: US 6,660,111 B2
(45) Date of Patent: Dec. 9, 2003

(54) METHOD OF MANUFACTURING AL-MG-SI SERIES ALLOY PLATE EXCELLENT IN THERMAL CONDUCTIVITY AND INTENSITY

(75) Inventors: Kyohei Taguchi, Osaka (JP); Ichizo Tsukuda, Osaka (JP); Kazuo Kimura, Nara (JP); Ryosuke Shimao, Osaka (JP)

(73) Assignee: Showa Aluminum Corp., Osaka (JP)

( * ) Notice: Subject to any disclaimer, the term of this patent is extended or adjusted under 35 U.S.C. 154(b) by 0 days.

(21) Appl. No.: 09/818,070

(22) Filed: Mar. 27, 2001

(65) Prior Publication Data

US 2002/0174923 A1 Nov. 28, 2002

(51) Int. Cl.[7] ..... C22F 1/04; C22F 1/05
(52) U.S. Cl. ..... 148/692; 148/693; 148/697
(58) Field of Search ..... 148/692, 693, 148/552, 697

(56) References Cited

FOREIGN PATENT DOCUMENTS

JP 05-009674 * 1/1993

OTHER PUBLICATIONS

"ASM Handbook vol. 4 Heat Treating", ASM International, 1991, pp 841–847,856.*

"Metals Handbook, Desk Edition" 2nd ed., ASM International, 1998, p5, 1038.*

* cited by examiner

*Primary Examiner*—George Wyszomierski
*Assistant Examiner*—Janelle Combs-Morillo

(57) ABSTRACT

An Al—Mg—Si series alloy ingot consisting essentially of Si:0.2–0.8 wt %, Mg:0.3–0.9 wt %, Fe:0.35 wt % or less, Cu:0.20 wt % or less and the balance of aluminum and inevitable impurities is prepared. The alloy ingot is homogenized, then subjected to rough hot rolling and finish hot rolling, and finally to cold rolling. One of the rough hot rolling is controlled such that material temperature immediately before one of the rough hot rolling is from 350 to 440° C., cooling rate between one of the rough hot rolling and rough hot rolling subsequent thereto is 50° C./min or more, material temperature immediately after one of the rough hot rolling is from 250 to 340° C. and plate thickness immediately after one of the rough hot rolling is 10 mm or less. The cold rolling is controlled such that rolling reduction is 30% or more.

10 Claims, No Drawings

METHOD OF MANUFACTURING AL-MG-SI SERIES ALLOY PLATE EXCELLENT IN THERMAL CONDUCTIVITY AND INTENSITY

BACKGROUND OF THE INVENTION

1. Field of the Invention

This invention relates to a method of manufacturing an Al—Mg—Si series alloy plate excellent in thermal conductivity and intensity.

2. Description of Related Art

Generally, Japanese Industrial Standards (hereinafter referred to as "JIS") A5052 aluminum alloy is used as high intensity aluminum materials for heat exchanger parts, metallic base printed circuit boards, cutting members, etc. However, JIS A5052 aluminum alloy is inferior in thermal conductivity by 30% or more as compared with pure aluminum. On the other hand, pure aluminum having high thermal conductivity is extremely low in strength and inferior to JIS A5052 aluminum alloy in cutting processability. This pure aluminum requires removal of burrs after cutting processing, resulting in poor finished surface appearance.

Furthermore, Al—Mg—Si series alloy is also used as aluminum material of high intensity in which fine $Mg_2Si$ particles are precipitated uniformly to improve the strength. The fine $Mg_2Si$ precipitation can be obtained by heat treatment, which improves strength and recovers toughness by hardening and annealing the alloy after cold rolling. Heating the alloy in general rolling process does not cause uniform and fine $Mg_2Si$ precipitation, but merely causes independent precipitation of Mg and Si, resulting in insufficient strength improvement.

Thus, under the present circumstances, it is additionally required to perform heat treatment after cold rolling, resulting in an increased step, which causes an increase in the manufacturing cost. Furthermore, in cases where a thin plate having a thickness of 0.1 mm or the like is manufactured from heat treatment type alloy such as Al—Mg—Si series alloy, since it was common to subject the alloy plate of 1 mm thickness or less to solution treatment in a continuous annealing furnace, it was difficult to increase the cold working rate. As a result, it was difficult to obtain high hardness.

Japanese Unexamined Laid-open Patent Publication No. H6-272001 discloses a method of manufacturing an Al—Mg—Si series alloy plate in which hot rolling conditions are specified. This technique intends to restrain big and rough precipitation from being generated during hot rolling in order to perform short-time solution treatment after cold rolling, and does not intend to promote fine $Mg_2Si$ precipitation during the rolling process.

SUMMARY OF THE INVENTION

It is an object of the present invention to provide a method of manufacturing aluminum alloy with outstanding thermal conductivity and hardness in fewer steps.

According to the present invention, a method of manufacturing an Al—Mg—Si series alloy plate excellent in thermal conductivity and hardness, includes the steps of: preparing Al—Mg—Si series alloy ingot consisting essentially of Si:0.2–0.8 wt %, Mg:0.3–0.9 wt %, Fe:0.35 wt % or less, Cu:0.20 wt % or less and the balance of aluminum and inevitable impurities; homogenizing the alloy ingot; subjecting the alloy ingot to rough hot rolling to obtain a roughly hot rolled plate; subjecting the roughly hot rolled plate to finish hot rolling to obtain a finished hot rolled plate; and subjecting the finished hot rolled plate to cold rolling, wherein one of the rough hot rolling is controlled such that material temperature immediately before the one of the rough hot rolling is from 350 to 440° C., cooling rate between the one of the rough hot rolling and rough hot rolling subsequent thereto is 50° C./min or more, material temperature immediately after the one of the rough hot rolling is from 250 to 340° C. and plate thickness immediately after the one of the rough hot rolling is 10 mm or less, and wherein the cold rolling is controlled such that rolling reduction is 30% or more.

It is preferable that Si content of the Al—Mg—Si series alloy ingot is from 0.32 to 0.60 wt % and/or Mg content of the Al—Mg—Si series alloy ingot is from 0.35 to 0.55 wt %.

It is preferable that the material temperature immediately before one of the rough hot rolling is from 380 to 420° C., and/or the plate thickness immediately after one of the rough hot tolling is 8 mm or less.

It is also preferable that the rolling reduction of the cold rolling is 50% or more.

Furthermore, it is preferable to further perform last annealing at 180° C. or below after the cold rolling

DETAILED DESCRIPTION OF THE INVENTION

The present invention will be detailed as follows. In the method of manufacturing an Al—Mg—Si series alloy plate excellent in thermal conductivity and hardness, the significance and reasons for the limitation of each element of the target Al—Mg—Si alloy composition will be explained as follows.

Mg and Si are essential elements for giving strength to the alloy. If Mg content is 0.3 wt % or less and/or Si content is 0.2 wt % or less, sufficient strength cannot be obtained. On the other hand, if Mg content exceeds 0.9 wt % and/or Si content exceeds 0.8 wt %, the rolling load in the hot rolling will increase, which causes a deterioration of productivity and necessitates trimming of the rolled plate before the finish rolling because of large cracks. The desirable lower limit of Mg content is 0.35 wt %, and the desirable upper limit thereof is 0.55 wt %. On the other hand, the desirable lower limit of Si content is 0.32 wt %, and the desirable upper limit thereof is 0.60 wt %.

Too much Fe and Cu causes a deterioration of corrosion resistance, resulting in an alloy plate of no practical use. Therefore, it is necessary to regulate the content of Fe and Cu such that Fe content is 0.35 wt % or less and Cu content is 0.20 wt % or less. The desirable Fe content is 0.25 wt % or less, and the desirable Cu content is 0.10 wt % or less.

The alloy composition falling within the aforementioned range causes outstanding thermal conductivity equivalent to pure aluminum.

In the method according to the present invention, fine $Mg_2Si$ particles can be precipitated uniformly by applying rolling under the prescribed conditions after the homogenization. As a result, effects equivalent to effects obtained by solution treatment and quenching can be obtained.

The conditions of the homogenization are not specifically limited. It is preferable to perform the homogenization for 2 hours or more at 500° C. or above in accordance with a conventional method.

In the rough hot rolling, effects equivalent to effects obtained by quenching can be obtained by the temperature reduction while rough hot rolling under the predetermined temperature conditions in any rough hot rolling pass. Therefore, the material temperature immediately before the rough hot rolling is required to fall within the range of from 350 to 440° C. which can retain the dissolved state of Mg and Si like in solution treatment. If the material temperature is below 350° C., $Mg_2Si$ becomes big and rough precipitation at this time, and thus the subsequent quenching effect cannot be obtained. Furthermore, since the material temperature is low, the rolling nature of the subsequent rough hot rolling pass deteriorates remarkably, the material temperature immediately after the rough hot rolling pass becomes too low, resulting in a deterioration of the surface quality. On the other hand, if the material temperature exceeds 440° C., the material temperature will not drop enough immediately after the rough hot rolling, causing insufficient quenching effects. The preferable lower limit of the material temperature immediately before the rough hot rolling is 380° C., and the preferable upper limit is 420° C. Furthermore, in order to obtain the quenching effects, it is required to control such that the cooling rate between subsequent rough hot rolling passes is 50° C./min and that the material temperature immediately after the hot rolling pass falls within the range of from 250 to 340° C. In order to control the material temperature immediately after the hot rolling pass so as to fall within the aforementioned range, forced cooling such as high-pressure shower water cooling may be performed immediately after the rough hot rolling. Furthermore, it is preferable that the rough hot rolling velocity is 50 m/min or higher. Furthermore, in order to obtain cooling effects equivalent to quenching between the rough hot rolling passes, it is necessary to control such that the plate thickness immediately after the rough hot rolling becomes 10 mm or less because of the following reasons If the thickness exceeds 10 mm, it is difficult to cool the plate to a temperature sufficient for quenching even if an additional water-cooling process is performed. The preferable plate thickness is 8 mm or less.

Generally, although the aforementioned rough hot rolling will be performed 10 times (passes) or more, the aforementioned rough hot rolling pass under the aforementioned conditions in order to obtain the quenching effects may be performed at any rough hot rolling pass. However, since it is required to make the plate thickness immediately after the rough hot rolling 10 mm or less, the aforementioned rough hot rolling is usually performed at the last rough hot rolling pass or at the rough hot rolling pass immediately before the last rough hot rolling pass. However, in cases where the aforementioned rough hot rolling is performed at a rough hot rolling pass other than the last rough hot rolling pass, it is required to perform the rough hot rolling subsequent to the pass at the material temperature of from 250 to 340° C. If the material temperature is below 250° C., the load of rolling becomes larger. As a result, it becomes hard to perform the rough hot rolling because of the large load and the surface changes in quality, e.g., the surface corrosion due to the reaction of aluminum and moisture.

The conditions of the final hot rolling performed after the rough hot rolling, such as the result temperature and/or the rolling velocity, are not specifically limited because solution treatment and quench treatment have been already performed by the preceding rough rolling. Accordingly, the final hot rolling may be performed depending on the plate thickness by a conventional method.

In the cold rolling, in order to obtain the predetermined hardness by work hardening, it is necessary to control such that the rolling reduction is 30% or more. When the rolling reduction is 30% or more, the hardness of 200 $N/mm^2$ or more which is equal to the hardness of JIS A5052 aluminum alloy can be obtained. A desirable rolling reduction is 50% or more.

Furthermore, if it requires, the last annealing of the cold rolled alloy plate may be performed at 180° C. or below. By performing the heat treatment at such a low temperature, the age hardening of the alloy plate will be executed to further increase the hardness and the elongation. Furthermore, mechanical characteristics will also be stabilized. The most preferable annealing temperature is from 130 to 150° C.

Since the target Al—Mg—Si series alloy to be manufactured in accordance with the manufacturing method according to the present invention consists essentially of Si:0.2–0.8 wt %, Mg:0.3–0.9 wt %, Fe:0.35 wt % or less, Cu;0.20 wt % or less and the balance of aluminum and inevitable impurities, the obtained Al—Mg—Si series alloy is excellent in thermal conductivity. The method of manufacturing an Al—Mg—Si series alloy plate according to the present invention includes the steps of: homogenizing the Al—Mg—Si series alloy ingot; subjecting the alloy to rough hot rolling to obtain a roughly hot rolled plate; subjecting the roughly hot rolled plate to finish hot rolling to obtain a finished hot rolled plate; and subjecting the finished hot rolled plate to cold rolling, wherein one of the rough hot rolling is controlled such that material temperature immediately before one of the rough hot rolling is from 350 to 440° C., cooling rate between one of the rough hot rolling and rough hot rolling subsequent thereto is 50° C./min or more, material temperature immediately after one of the rough hot rolling is from 250 to 340° C. and plate thickness immediately after one of the rough hot rolling is 10 mm or less, and wherein the cold rolling is controlled such that rolling reduction is 30% or more. Accordingly, during the rough hot rolling, it is possible to obtain effects equivalent to the effects obtained by solution treatment and quench treatment. Furthermore, still higher hardness can be obtained by the cold rolling at the high rolling reduction. Therefore, without performing heat treating at another process other than rolling process, an alloy plate having high thermal conductivity and high hardness can be manufactured, and a large cost reduction can be attained. Furthermore, since the Al—Mg—Si series alloy plate manufactured by the method shown here has good cutting ability, when cutting of this alloy plate is performed, post processing, such as deburring, become unnecessary and a cost reduction can also be attained. Furthermore, since the thermal conductivity of Al—Mg—Si series alloy is good, the alloy plate having high thermal conductivity and high hardness can be manufactured by the aforementioned method.

Furthermore, in the aforementioned Al—Mg—Si series alloy ingot composition, in cases where Si content is from 0.32 to 0.60 wt % and/or Mg content is from 0.35 to 0.55 wt %, the obtained alloy plate is excellent especially in hardness.

Furthermore, in cases where the material temperature immediately before one of rough hot rolling is from 380 to 420° C., sufficient quenching effects can be obtained while maintaining the rolling nature.

Furthermore, in cases where the plate thickness immediately after one of the rough hot rolling is 8 mm or less, the plate can be fully cooled between the rough hot rolling passes. Thus, sufficient quenching effects can be obtained.

Furthermore, in cases where the rolling reduction at the cold rolling is 50% or more, the strength improvement effect due to work hardening will be remarkable.

By performing the last annealing at the temperature of 180° C. or below after the cold working, the hardness of the alloy plate can be further improved, the elongation can also be increased and the mechanical characteristics can be stabilized.

EXAMPLE

Each of the alloy continuous casting slabs having compositions shown in Table 1 was subjected to homogenization treatment of 580° C.×10 hours after surface cutting, and then subjected to rough hot rolling, final hot rolling and cold rolling to obtain an alloy plate. The rolling conditions were controlled at the final rough hot rolling pass. The material temperature immediately before the final rough hot rolling pass was set to the temperature shown in Table 1, the final rough hot rolling velocity was set to 80 m/min, and the thickness immediately after the final rough hot rolling was set as shown in Table 1. Then, the material after the rough hot rolling was subjected to further finish hot rolling to be rolled into a coil. Next, the rolled material was subjected to cold rolling at the rolling reduction shown in Table 1. After the cold rolling, the examples Nos. 2, 4 and 11 and the comparative examples Nos. 7 and 9 were further subjected to the final annealing under the conditions shown in Table 1. As for the comparative examples Nos. 1, 2 and 3, A1100P-H24 material, A5052P-H38 material, and A5052P-H34 material were manufactured by usual processing, respectively.

Tensile strength and thermal conductivity of each obtained alloy plate were measured, and its cutting ability was also evaluated. The tensile strength was measured by the conventional method with JIS No.5 specimen, and the thermal conductivity was measured with a laser flash method at 25° C. Furthermore, the cutting ability was relatively evaluated on the basis shown below. However, as for the examples Nos. 10 and 11, since the final plate thickness was 0.1 mm and this kind of thin plate or foil will be usually used without being subjected to cutting process, the cutting ability were not evaluated.

○: Outstanding (no burrs)

Δ: Good (some burrs)

x: Poor (many burrs).

TABLE 1

| Alloy | Composition (wt %) Balance: Al | | | | Final rough hot rolling pass | | | Cold rolling | | Thermal | | | |
|---|---|---|---|---|---|---|---|---|---|---|---|---|---|
| | | | | | Start Temp. | Final Temp. | Final Thickness | Rolling reduction | Final annealing | Tensile Strength | Conductivity (cal/cm · | Cutting | |
| No. | Si | Mg | Fe | Cu | (° C.) | (° C.) | (mm) | (%) | (° C. × hr) | (N/mm²) | sec · ° C.) | ability | Remark |
| EXAMPLE | | | | | | | | | | | | | |
| 1 | 0.5 | 0.5 | 0.15 | 0.05 | 395 | 277 | 7 | 60 | — | 228 | 0.48 | ○ | |
| 2 | 0.5 | 0.5 | 0.15 | 0.05 | 395 | 277 | 7 | 60 | 150 × 5 | 255 | 0.52 | ○ | |
| 3 | 0.5 | 0.5 | 0.15 | 0.05 | 395 | 282 | 7 | 85 | — | 258 | 0.46 | ○ | |
| 4 | 0.5 | 0.5 | 0.15 | 0.05 | 395 | 282 | 7 | 85 | 140 × 5 | 281 | 0.51 | ○ | |
| 5 | 0.5 | 0.5 | 0.15 | 0.05 | 436 | 317 | 7 | 85 | — | 233 | 0.50 | ○ | |
| 6 | 0.7 | 0.4 | 0.18 | 0.07 | 400 | 332 | 10 | 60 | — | 222 | 0.49 | ○ | |
| 7 | 0.3 | 0.8 | 0.13 | 0.05 | 396 | 325 | 10 | 65 | — | 247 | 0.47 | ○ | |
| 8 | 0.3 | 0.4 | 0.13 | 0.05 | 394 | 320 | 10 | 70 | — | 255 | 0.52 | ○ | |
| 9 | 0.4 | 0.7 | 0.20 | 0.15 | 392 | 288 | 7 | 85 | — | 292 | 0.46 | ○ | |
| 10 | 0.4 | 0.7 | 0.13 | 0.05 | 400 | 330 | 7 | 98 | — | 368 | 0.46 | — | Thickness 0.1 mm |
| 11 | 0.4 | 0.7 | 0.13 | 0.05 | 400 | 330 | 7 | 98 | 130 × 5 | 379 | 0.47 | — | Thickness 0.1 mm |
| COMPARATIVE EXAMPLE | | | | | | | | | | | | | |
| 1 | 0.12 | 0.01 | 0.57 | 0.12 | 395 | 290 | 7 | 75 | — | 140 | 0.52 | x | A1100P-H24 |
| 2 | 0.07 | 2.51 | 0.25 | 0.02 | 395 | 292 | 7 | 70 | — | 295 | 0.33 | ○ | A5052P-H38 |
| 3 | 0.07 | 2.51 | 0.25 | 0.02 | 396 | 288 | 7 | 70 | — | 255 | 0.34 | ○ | A5052P-H34 |
| 4 | 0.1 | 0.2 | 0.10 | 0.05 | 394 | 282 | 7 | 85 | — | 170 | 0.51 | Δ | |
| 5 | 0.9 | 0.5 | 0.14 | 0.14 | 390 | 280 | 11 | 70 | — | 182 | 0.43 | Δ | |
| 6 | 0.5 | 1.0 | 0.11 | 0.08 | 395 | 295 | 11 | 70 | — | 270 | 0.38 | ○ | |
| 7 | 0.5 | 1.0 | 0.11 | 0.06 | 390 | 290 | 11 | 70 | 150 × 5 | 278 | 0.39 | ○ | |
| 8 | 0.5 | 0.5 | 0.15 | 0.05 | 450 | 362 | 7 | 60 | — | 178 | 0.50 | Δ | |
| 9 | 0.5 | 0.5 | 0.15 | 0.05 | 454 | 366 | 7 | 60 | 150 × 5 | 171 | 0.51 | Δ | |

As will be apparent from the results shown in Table 1, it was confirmed that the aluminum alloy plate with high thermal conductivity equivalent to pure aluminum and high hardness equivalent to JIS A5052 alloy can be obtained by subjecting to rough hot rolling and cold rolling under the conditions as defined by the present invention. Furthermore, the cutting ability was also good. The hardness was also improved by further subjecting it to the final annealing.

The terms and expressions which have been employed herein are used as terms of description and not of limitation, and there is no intent, in the use of such terms and expression, of excluding any of the equivalents of the features shown and described or portions thereof, but it is recognized that various modifications are possible which fall within the scope of the presently claimed invention.

What is claimed is:

1. A method of manufacturing an Al—Mg—Si series alloy plate excellent in thermal conductivity and hardness, the method comprising the steps of:

preparing Al—Mg—Si series alloy ingot consisting essentially of Si: 0.2–0.8 wt %, Mg: 0.3–0.9 wt %, Fe: 0.35 wt % or less, Cu:0.20 wt % or less and the balance of aluminum and inevitable impurities;

homogenizing said alloy ingot;

subjecting said alloy ingot to rough hot rolling to obtain a roughly hot rolled plate;

subjecting said roughly hot rolled plate to finish hot rolling to obtain a finished hot rolled plate; and subjecting said finished hot rolled plate to cold rolling to obtain a cold rolled plate, wherein one of plural passes preformed at said rough hot rolling is controlled such that material temperature immediately before said one of plural passes is from 350 to 440° C., cooling rate between said one of plural passes and a pass subsequent thereto is 50° C./min or more, material temperature immediately after said one of plural passes is from 250 to 340° C. and plate thickness immediately after said one of plural passes is 10 mm or less, wherein said cold rolling is controlled such that rolling reduction is 30% or more, and wherein said cold rolled plate is subjected to final aging at a temperature of 180°C. or below, or is not subjected to final aging.

2. The method of manufacturing an Al—Mg—Si series alloy plate as recited in claim 1, wherein Si content of said Al—Mg—Si series alloy ingot is from 0.32 to 0.60 wt %.

3. The method of manufacturing an Al—Mg—Si series alloy plate as recited in claim 1, wherein Mg content of said Al—Mg—Si series alloy ingot is from 0.35 to 0.55 wt %.

4. The method of manufacturing an Al—Mg—Si series alloy plate as recited in claim 1, wherein said material temperature immediately before said one of plural passes is from 380 to 420° C.

5. The method of manufacturing an Al—Mg—Si series alloy plate as recited in claim 1, wherein said plate thickness immediately after said one of plural passes in 8 mm or less.

6. The method of manufacturing an Al—Mg—Si series alloy plate as recited in claim 1, wherein said material temperature immediately before said one of plural passes is from 380 to 420° C., and wherein said plate thickness immediately after said one of plural passes is 8 mm or less.

7. The method of manufacturing an Al—Mg—Si series alloy plate as recited in claim 1, wherein said rolling reduction of said cold rolling is 50% or more.

8. The method of manufacturing an Al—Mg—Si series alloy plate as recited in claim 1, wherein said material temperature immediately before said one of plural passes is from 380 to 420° C., and wherein said rolling reduction of said cold rolling is 50% or more.

9. The method of manufacturing an Al—Mg—Si series alloy plate as recited in claim 1, wherein said plate thickness immediately after said one of plural passes is 8 mm or less, and wherein said rolling reduction of said cold rolling is 50% or more.

10. The method of manufacturing an Al—Mg—Si series alloy plate as recited in claim 1, wherein said material temperature immediately before said one of plural passes is from 380 to 420° C., wherein said plate thickness immediately after said one of plural passes is 8 mm or less, and wherein said rolling reduction of said cold rolling is 50% or more.

* * * * *

UNITED STATES PATENT AND TRADEMARK OFFICE

CERTIFICATE OF CORRECTION

PATENT NO. : 6,660,111 B2 
DATED : December 9, 2003
INVENTOR(S) : Kyohei Taguchi et al.

It is certified that error appears in the above-identified patent and that said Letters Patent is hereby corrected as shown below:

Title page,
Item [73], Assignee, delete "Showa Aluminum Corp., Osaka (JP)" and replace with -- Showa Denko K.K., Tokyo, Japan --

Signed and Sealed this

Twenty-second Day of March, 2005

JON W. DUDAS
*Director of the United States Patent and Trademark Office*